United States Patent [19]

Shaw et al.

[11] Patent Number: 4,872,517

[45] Date of Patent: Oct. 10, 1989

[54] ROTATABLE FLUID CONDUCTOR FOR WELL APPARATUS

[76] Inventors: Danial G. Shaw, 50 Cane River La., Conroe, Tex. 77302; Billy MacCline, 6923 Shavelson, Houston, Tex. 77055

[21] Appl. No.: 153,136

[22] Filed: Feb. 8, 1988

[51] Int. Cl.[4] ..... E21B 3/00

[52] U.S. Cl. ..... 173/163; 277/82

[58] Field of Search ..... 173/163, 164, 73, 71; 277/32, 82

[56] References Cited

U.S. PATENT DOCUMENTS

| | | | |
|---|---|---|---|
| 3,695,669 | 10/1972 | Langowski | 294/ |
| 4,256,313 | 4/1980 | Arnold | 277/ |
| 4,449,596 | 8/1982 | Boyadjieff | 175/ |
| 4,529,045 | 7/1985 | Boyadjieff et al. | 173/164 |
| 4,625,977 | 12/1986 | Azibert et al. | 277/82 |

OTHER PUBLICATIONS

Varco Top Drive Drilling System Description and Specifications Technical Bulletin, May 1985 (see pp. 22–24).

Torque-Right Top Drive Drilling System, 1986.

*Primary Examiner*—Frank T. Yost

*Assistant Examiner*—William Fridie, Jr.

*Attorney, Agent, or Firm*—Guy McClung

[57] ABSTRACT

A non-rotating fluid conductor for use with well apparatuses. A top drive with such a conductor and methods of using such a conductor and such a top drive. The conductor in one embodiment has a tripartite gland with outer, central, and inner gland members. The central gland member is movable in response to externally applied fluid pressure to bring into communication one or more passages through the conductor which includes passages through the outer member and inner member which are brought into communication when a passage on the central member aligns with the passages of the inner and outer members. Appropriate configuration of and biasing of the central gland member provides non-contacting of the central and inner members unless the conductor is in an energized mode.

13 Claims, 5 Drawing Sheets

ROTATABLE FLUID CONDUCTOR FOR WELL APPARATUS

BACKGROUND OF THE INVENTION

1. Field of the Invention

This invention is directed to rotatable fluid conductors for conducting pressurized fluid to well apparatuses and particularly to a top drive with such a conductor.

2. Related Applications and Description of Prior Art

A variety of problems are associated with the use of prior art rotatable fluid conductors. In many prior art devices it is difficult to properly effect a metal-to-metal contacting rotary seal and often, once this is achieved, the contact of metal-to-metal causes galling or excessive wear.

In accordance with §1.56 of 37 C.F.R., the following are disclosed:

| U.S. Pat. No. | |
|---|---|
| 4,529,045 | Top drive with sealing rotatable fluid conductor |
| 3,695,669 | Rotatable fluid conductor for elevator |
| 4,449,596 | Top drive for wells |
| 4,625,977 | Rotary seal assembly |
| 4,256,313 | Universal mechanical seal gland |

Publication
Varco Top Drive Drilling System Description and Specifications Technical Bulletin, May 1985, (see pp. 22–24)
Torque-Right Top Drive Drilling System, 1986

Prior art top drives are discussed in our copending U.S. patent application entitled "Hydraulic Top Drive for Wells", Ser. No. 07/016,980 filed Feb. 26, 1987 and in the prior art cited therein. Prior art elevator link tilt mechanisms are discussed in our copending U.S. patent application Ser. No. 07/099,771 filed Sept. 22, 1987 and our assembly includes a rotatable sealing gland.

There has long been a need for an efficient and effective rotatable fluid conductor or seal. There has long been a need for an efficient and effective rotatable fluid conductor which permits non-contacting movement of a drive shaft or of a portion of the conductor on the shaft until the fluid conductor is energized. There has long been a need for an efficient and effective drilling and well apparatuses including, but not limited to, a top drive apparatus which such a non-contacting rotatable fluid conductor. The present invention recognizes, addresses, and satisfies these long-felt needs.

SUMMARY OF THE INVENTION

This invention is directed to a non-rotating fluid conductor for use with well apparatuses and also to a top drive with such a conductor. The conductor in one embodiment has a tripartite gland with outer, central, and inner gland members. The central gland member is movable in response to externally applied fluid pressure to bring into communication one or more passages through the conductor which includes passages through the outer member and inner member which are brought into communciation when a passage on the central member alings with the passages of the inner and outer members. Appropriate configuration of and biasing of the central gland member provides non-contacting of the central and inner members unless the conductor is in an energized mode. This fluid conductor can be used in top drives, shaft mounted clutches, shaft mounted brakes, powered elevator gate latches, and other devices whose operation is enhanced by its use such as devices requiring that lubricant be conducted to a shaft or for transfer of liquids or gases from an outside source to a rotatable inner tubular member.

The present invention provides a top drive drilling apparatus (which may have an electrical motor, a hydraulically powerd motor or a pneumatically powerd motor means) which incorporates the new rotatable fluid conductor.

It is therefore an object of the present invention to provide a novel, unobvious, efficient, and effective rotatable fluid conductor for well apparatus.

Another object of this invention is the provision of such a conductor which permits non-contacting rotation of a drive shaft or of a sealing part or gland member on a drive shaft.

An additional object of this invention is the provision of a top drive apparatus having such a fluid conductor.

Another object is the provision of other well apparatuses with such a fluid conductor.

To one of skill in this art who has the benefit of this invention's teachings, other and further objects, features, and advantages will be clear from the following description of presently-preferred embodiments, given for the purpose of disclosure, when taken in conjunction with the accompanying drawings.

DESCRIPTION OF PREFERRED EMBODIMENTS

Figure 1:
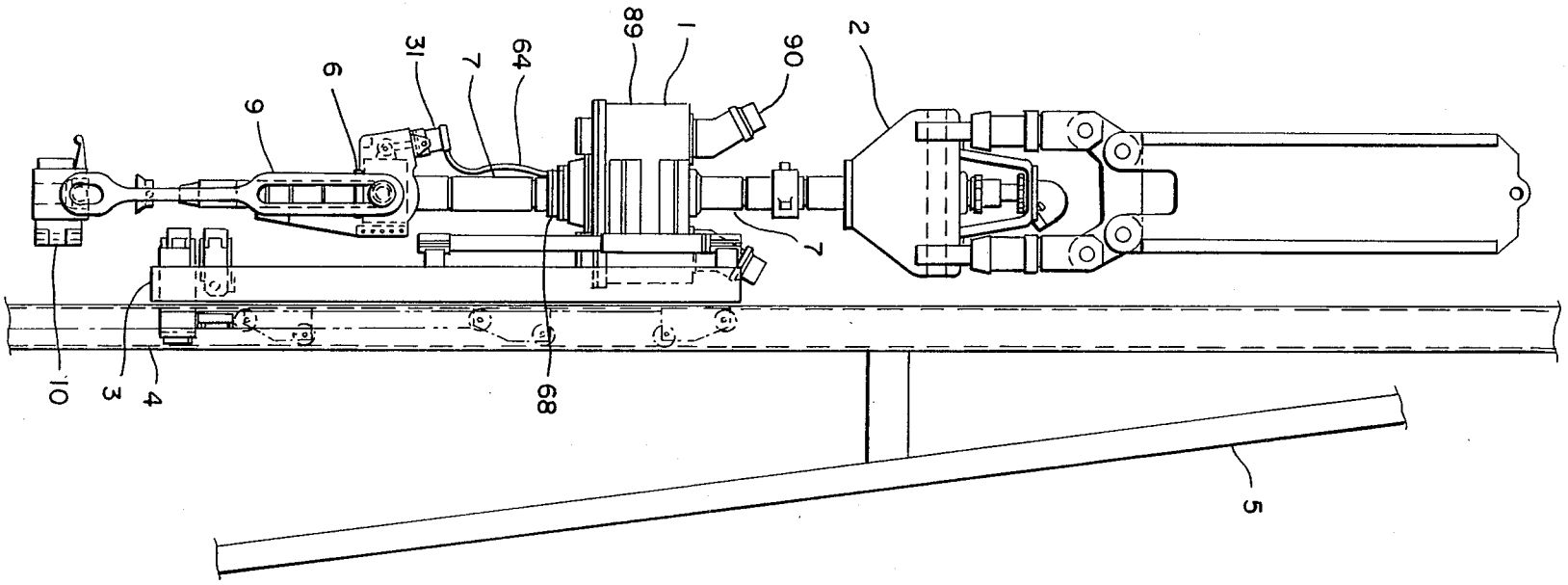
FIG. 1 is a side view of a well drilling rig having a top drive drilling system with a non-rotating fluid conductor according to the present invention.

Referring now to FIG. 1, a top drive drilling unit 1 on a derrick 5 has an elongated guide structure 4 and a conventional drilling swivel 2. Threadably connected to the swivel 2 is a top drive shaft 7 which extends uninterrupted through the central axis of the top drive 1. The top drive 1 has a housing 89 and a motor 90. Attached to the lower end of the drive shaft 7 is an elevator link adapter 6 which supports elevator links 9. Attached to the links 9 in a drill pipe elevator 10 of the general type found on a drilling rig. The top drive 1 is preferably attached to a guide dolly 3 which is contained by an elongated structure 4 for guiding the top drive upward or downward in the derrick. A cylinder 31 is shown supported by the link adapter 6 and a fluid conductor 64 is shown connecting the cylinder 31 to a rotatable seal gland 68. Although the top drive shown is preferably hydraulically powered, the fluid conductor can be used with an electrically or pneumatically powered top drive.

Figure 2:
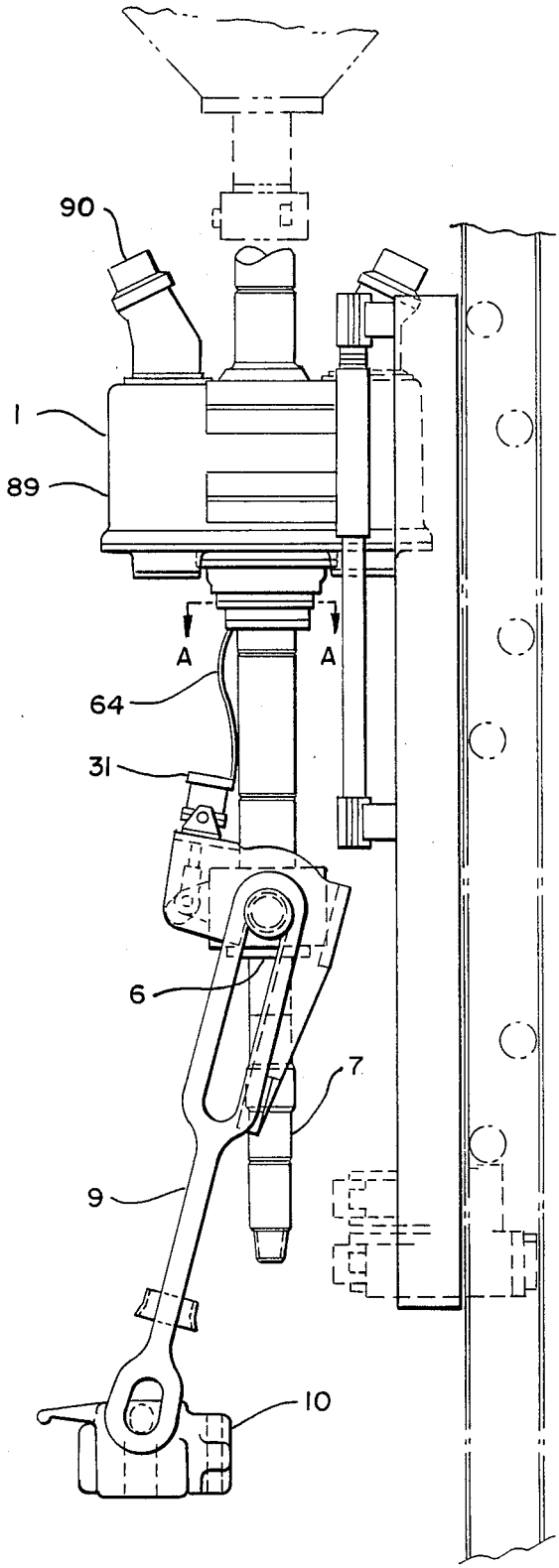
FIG. 2 is a side view of the system of FIG. 1 showing a portion of the system tilted from the axis of the derrick.

Referring now to FIG. 2, a pressurized fluid has been introduced through the conductor 64 and the elevator 10 has been moved away from the vertical axis of the derrick and of the well.

Figure 3:
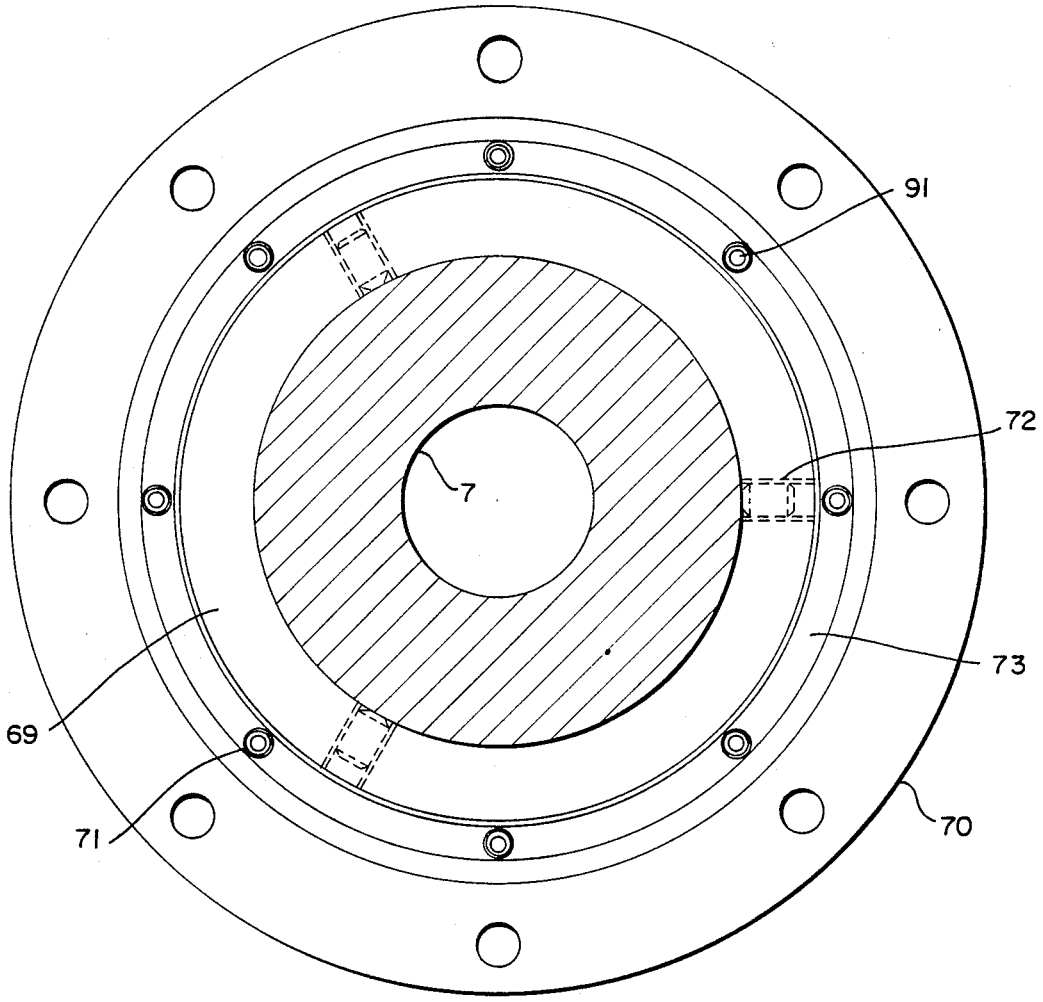
FIG. 3 is a top view along line A—A of FIG. 2 partially in cross section of a rotatable gland means of a device according to the present invention.
Figure 4:
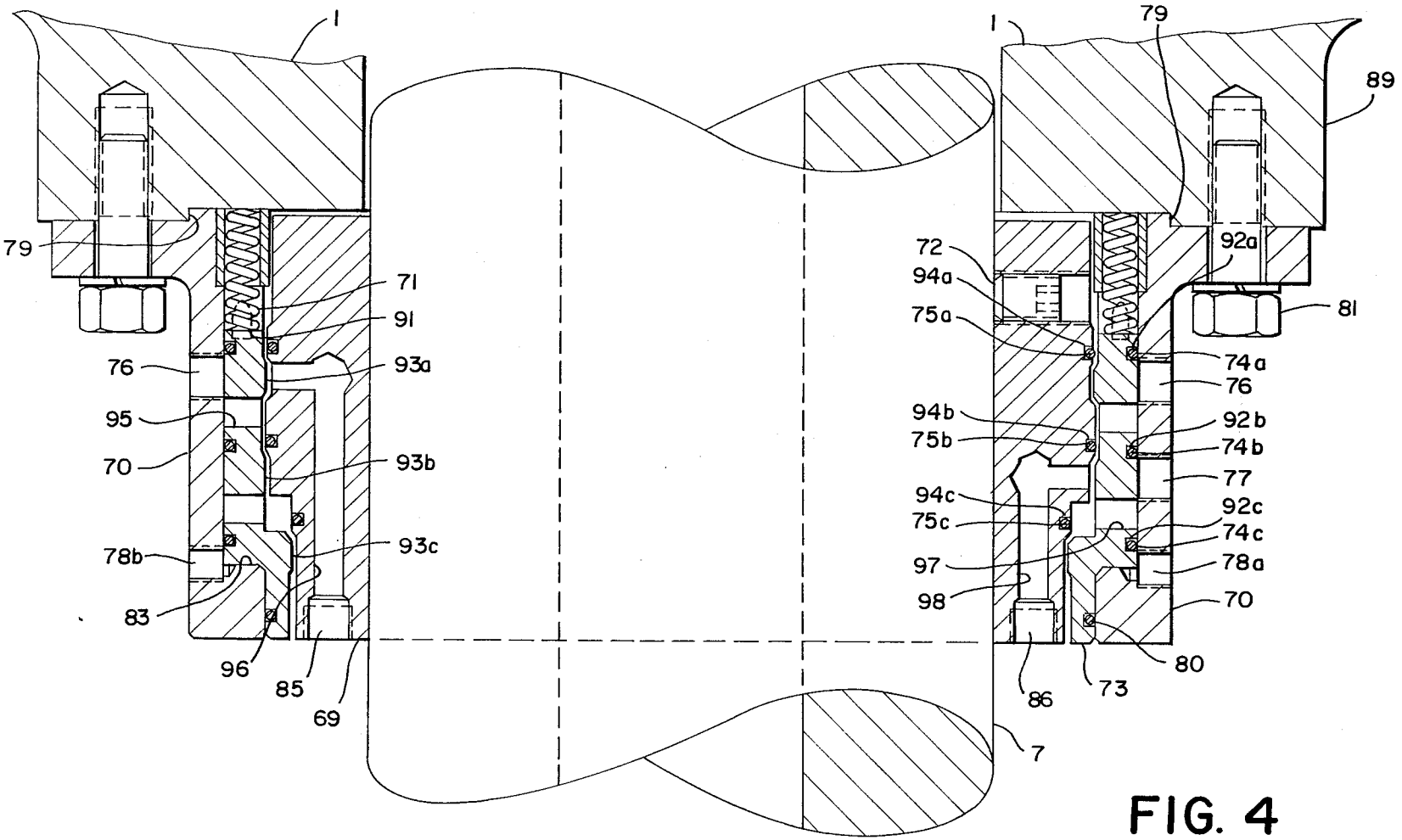
FIG. 4 is a cross sectional view of the system of FIG. 2 depicting a rotable gland means in a non-energized, noncontacting attitude.

Referring now to FIGS. 3 and 4, the rotatable seal gland 68 has a annular gland ring 69 which is disposed about the top drive shaft 7 and is restrained in place by set screws 72. Return springs 71 are disposed on the top of central gland member 73 and are retained by pins 91 and function to return the member 73 firmly against a shoulder 83. The outer gland member 70 functions to provide a barrel for a central gland member 73 to seal against through the action of sealing rings 74*a*, 74*b*, 74*c* and also provides entry ports for the fluid being communicated through the fluid conductor 64. Disposed about the inner gland ring 69 is the central gland inner member 73. Sealing rings 75*a*, 75*b*, 75*c* are disposed in annular grooves 94*a*, 94*b*, 94*c* respectively on the outside diameter of the inner gland 69. The sealing rings 74*a*, 74*b*, 74*c* are disposed in annular grooves 92*a*, 92*b*, 92*c* respectively on the outer diameter of gland member 73. The outer gland member 70 is attached to the housing 89 of the top drive 1 by screwed fasteners 81 and is centrally located by a projecting shoulder 79. Inlet ports or channels 76, 77 and 78 are disposed about and extend through the outer member 70. In a non-energized mode (FIG. 4) the various channels in the various gland members are not aligned with each other and fluid cannot pass through the conductor to a second well apparatus; e.g. channels 76 (in outer gland member 70), 95 (in central gland member 73), 96 (in inner gland member 69) and 85 (exit port for channel 96 in inner gland member 69); channels 77, 97, 98, and 86 are also not aligned in such a non-energized mode—77 (in outer gland member); 97 (in the central gland member); 98 and 86 (exit port or channel in the inner gland member 69).

The illustrated arrangement of the respective sealing gland members or parts 69, 73 and 70 is normal for a nonenergized mode with the central gland member not in contact with the inner gland member as shown in FIG. 4 and with the various channels in the three members non-aligned so that fluid does not pass through them. Compression springs 71 yieldably urge the central gland member 73 against a projecting shoulder 83 of the outer housing 70. The inner gland member ring 69 is clamped to the top drive shaft 7 by set screw compressing fittings 72, thereby effectively locking the annular gland ring 69 to the drive shaft 7. A sealing ring 80 provides a seal between the outer diameter of member 73 and the inner diameter of member 70.

Figure 5:
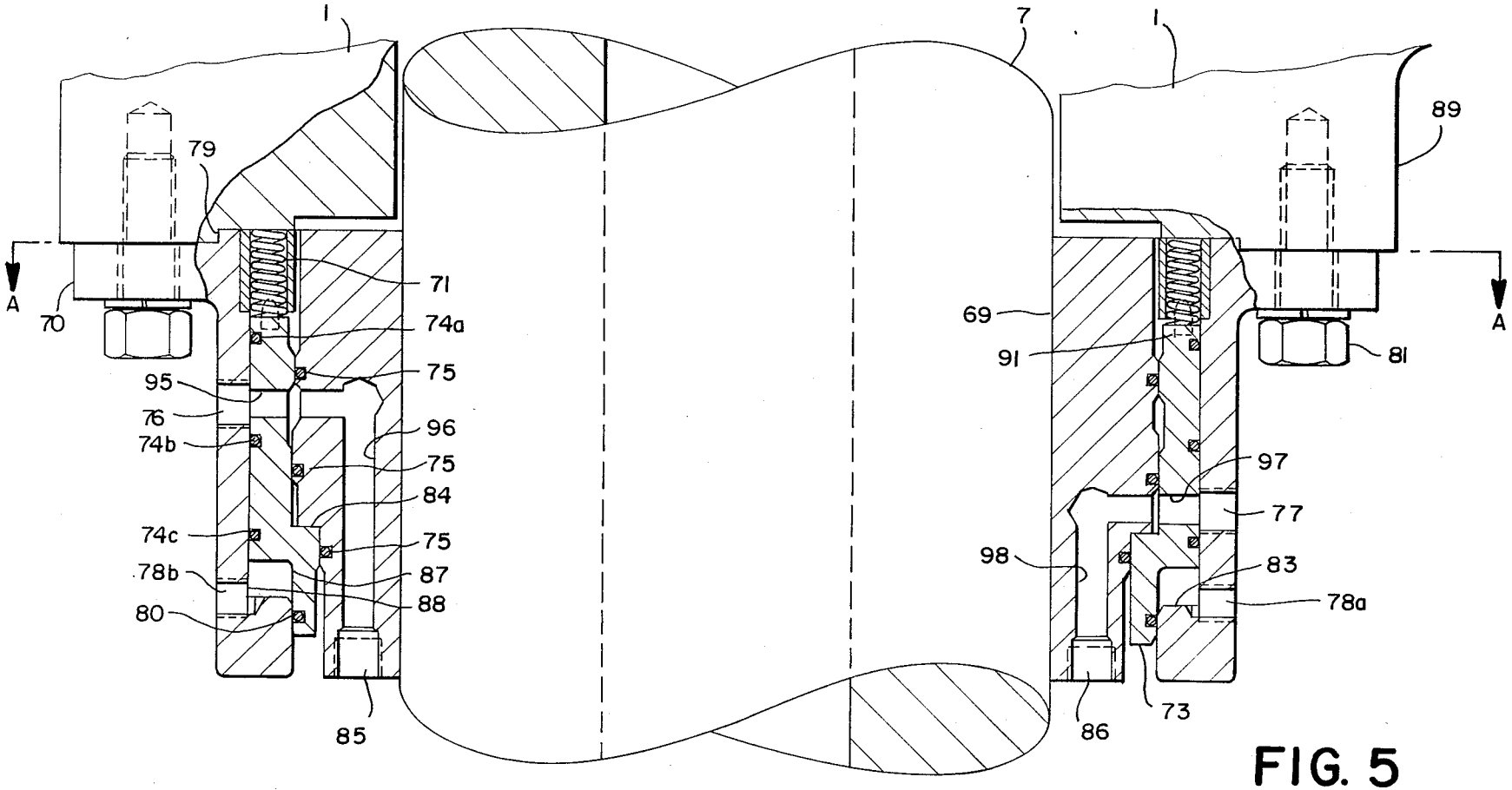
FIG. 5 is a cross sectional view of the system of FIG. 2 depicting the rotatable gland means in the active or energized mode and contacting sealing surfaces.

Referring now to FIG. 5, a pressurized gas or liquid has been applied through the inlet port 78*a* or 78*b*. Pressure is trapped between the sealing rings 74*c* and ring 80. These rings are of different diameters. Pressure tends to provide ring 80 downward and at the same time tends to force ring 74*c* upward. Since ring 74 is of a larger diameter, the net resultant force is upward. This moves the central gland member 73 upward and away from the shoulder 83 and at the same time reacts against the lower sealing ring 74 moving the central gland member 73 toward a shoulder 84. The differential force created by the difference between diameter 87 and diameter 88 will oppose the downward urging force of springs 71 and will shoulder central gland member 73 against shoulder 84. The springs 71 will be urged to a shorter length and will store energy for potential use. The inlet ports or channels 76 and 77 will then be in communication with outlet ports or channels 85 and 86 respectively, via the alignment of channels 76, 95, 96 and 85 and the alignment of channels 77, 97, 98, and 86. The sealing rings 74 will ensure that the gas or liquid entering the inlet ports or channels 76 and 77 will be properly directed to the respective outlets or channels 85 and 86. Upon release of gas or liquid pressure from inlet channel 76 or 78, or 77 and 78d, the springs 71 will urge the central gland member 73 against shoulder 83 and thereby effectively eliminate significant contact between the central gland member 73 and the inner gland member 69. This will allow a non-contacting rotation of central shaft 7 about a central axis. As shown in FIG. 4 the seals 75 do not contact the inner gland member 73 in the non-energized mode. However, when the member 73 has been moved upwardly (see FIG. 5) ridges 92*a*, 93*b*, and 93*c* of the member 73 (see FIG. 4) move into sealing contact with the seals 75*a*, 75*b*, and 75*c* respectively.

While this disclosure depicts two fluid paths, it is within the scope of this invention to provide one path or more than two by adding appropriate additional inlets and channels in the members 69, 73 and 70.

In conclusion, therefore, it is seen that the present invention and the embodiments disclosed herein are well adapted to carry out the objectives and obtain the ends set forth at the outset as well as others inherent therein. Certain changes can be made in the apparatuses disclosed without departing form the spirit and the scope of this invention. While there have been described various embodiments of the present invention, the apparatuses described are not intended to be understood as limiting the scope of the invention. It is realized that changes therein are possible and it is further intended that each element recited in any of the following claims, and each combination of elements, is to be understood as referring to all equivalent elements and equivalent combinations, for accomplishing substantially the same results in substantially the same or equivalent manner. It is intended that the claims cover the invention broadly in whatever form its principles may be utilized.

We claim:

1. A fluid conductor for conducting fluid under pressure to a second well apparatus, the fluid conductor connectible to a first well apparatus, the fluid to be conducted flowable through the fluid conductor, the conductor comprising an inner gland member securable to a shaft passing therethrough, a central gland member non-contactingly disposed about the inner gland member, an outer gland member securable to the first well apparatus and disposed about the central and inner gland members, the inner gland member having inner hollow channel means, extending therethrough, the central gland member having central hollow channel means extending therethrough, the outer gland member having outer hollow channel means extending therethrough, the hollow channel means of the three members being non-aligned when the conductor is in a non-energized mode so that fluid cannot pass through all of them, and the central gland member movable to contact the inner gland member in response to pressurized fluid contacting the central gland member so that its hollow channel means aligns with the hollow channel means of the inner and outer gland members permitting the flow of the pressurized fluid into the hollow channel means of the outer gland member, through the hollow channel means of the central gland member, through and out of the hollow channel means of the inner gland member and thereby through and out from the fluid conductor for communication to the second well apparatus.

2. The fluid conductor of claim 1 wherein the central gland member is urged downwardly by spring means biased against the first well apparatus.

3. The fluid conductor of claim 1 wherein the central gland member is movable upwardly by the force of a pressurized fluid on the central gland member, the pressurized fluid brought into contact with the central gland member through an inlet extending through the outer gland member.

4. The fluid conductor of claim 1 including also seal means for each channel means to prevent the leakage of fluid from the channel means.

5. The fluid conductor of claim 1 wherein seal means are provided on the inner gland member which do not contact the central gland member when the conductor is in a non-energized mode but which do not contact the central gland member upon upward movement of the central gland member to provide sealing near the interfaces of the hollow channel means.

6. A top drive apparatus for rotating a tubular member in well operations, the top drive apparatus comprising a housing motor means connected to a drive means, the drive means including a drive shaft for connection to the tubular member to be rotated, and a fluid conductor for conducting fluid under pressure to a second well apparatus used in conjunction with the top drive, the fluid under pressure to be conducted flowable through the fluid conductor, the conductor comprising an inner gland member secured to the drive shaft of the top drive apparatus passing therethrough;

a central gland member disposed about the inner gland member, the central gland member not contacting the inner gland member when the fluid conductor is in a non-energized mode, an outer gland member secured to the housing of the top drive apparatus and disposed about the central and inner gland members, the inner gland member having inner hollow channel means, extending therethrough, the central gland member having central hollow channel means extending therethrough, the outer gland member having outer hollow channel means extending therethrough, the hollow channel means of the three members being non-aligned when the conductor is in a non-energized mode so that fluid cannot pass through all of them, and the central gland member movable against the force at the spring means in response to pressurized fluid contacting the central gland member so that its hollow channel means aligns with the hollow channel means of the inner and outer gland members permitting the flow of the pressurized fluid into the hollow channel means of the outer gland member, through the hollow channel means of the central gland member, through and out of the hollow channel means of the inner gland member and thereby through and out from the fluid conductor for communication to the second well apparatus.

7. The top drive apparatus of claim 6 wherein the central gland member is urged downwardly by spring means biased against the top drive housing.

8. The top drive apparatus of claim 6 wherein the fluid conductor's central gland member is movable upwardly by the force of a pressurized fluid on the central gland member, the pressurized fluid brought into contact with the central gland member through an inlet extending through the outer gland member.

9. The top drive apparatus of claim 6 including also seal means for each channel means to prevent the leakage of fluid from the channel means.

10. The top drive apparatus of claim 6 wherein the fluid conductor's seal means are provided on the inner gland member which do not contact the central gland member when the conductor is in a non-energized mode but which do contact the central gland member upon upward movement of the central gland member to provide sealing near the interfaces of the hollow channel means.

11. The top drive apparatus of claim 6 wherein the motor means is electric motor means.

12. The top drive apparatus of claim 6 wherein the motor means is hydraulically powered motor means.

13. A fluid conductor for conducting fluid under pressure to a second well apparatus, the fluid conductor connectible to a first well apparatus, the conductor comprising an inner gland member securable to a shaft passing therethrough, a central gland member disposed about the inner gland member, the central gland member not contacting the inner gland member when the fluid conductor is in a non-energized mode, an outer gland member securable to the first well apparatus and disposed about the central and inner gland members, spring means urging the central gland member downwardly and biased against the first well apparatus, the inner gland member having inner hollow channel means, extending therethrough, the central gland member having outer hollow channel means extending therethrough, the outer gland member having outer hollow channel means extendng therethrough.

the hollow channel means of the three members being non-aligned in a non-energized mode so that fluid cannot pass through all of them, and the central gland member movable against the force of the spring means in response to pressurized fluid contacting the central gland member so that its hollow channel means aligns with the hollow channel means of the inner and outer gland members permitting the flow of fluid into the hollow channel means of the outer gland member, through the hollow channel means of the central gland member, through and out of the hollow channel means of the inner gland member for communication to the second well apparatus, the pressurized fluid brought into contact with the central gland member through an inlet extending through the outer gland member, channel seal means for sealing each channel means to insure that fluid does not leak from the channel means, and inner gland member seal means on the inner gland member which do not contact the central gland member when the conductor is in a non-energized mode but which do contact the central gland member upon upward movement of the central gland member to provide sealing near the interfaces of the hollow channel means.

* * * * *